United States Patent [19]

Brasa

[11] Patent Number: 4,526,100

[45] Date of Patent: Jul. 2, 1985

[54] GRIPPER DEVICE FOR TRANSPORTING AND REGISTERING PLATES OR SHEETS TO BE OVERPRINTED ON SILK SCREEN PRINTING MACHINES IN ONE OR MORE COLORS

[75] Inventor: Umberto Brasa, Milan, Italy

[73] Assignee: Siasprint S.r.l., Milan, Italy

[21] Appl. No.: 608,646

[22] Filed: May 9, 1984

[30] Foreign Application Priority Data

May 20, 1983 [IT] Italy ..... 21212 A/83

[51] Int. Cl.[3] ..... B41F 1/28; B41F 1/36; B41L 21/06; B41L 21/12

[52] U.S. Cl. ..... 101/408; 101/128.1; 271/85; 271/204; 198/486; 198/695; 198/696; 74/99 A; 74/107

[58] Field of Search ..... 101/118, 128.1, 232, 101/378, 408, 410; 271/84, 85, 204, 268, 277; 198/479, 486, 695, 696; 74/99 A, 102, 107; 24/67 R, 67.3, 67.5, 67.7, 67.9, 67.11; 73/856, 857; 402/64, 66

[56] References Cited

U.S. PATENT DOCUMENTS

| | | | |
|---|---|---|---|
| 231,444 | 8/1880 | O'Donel | 271/85 |
| 2,984,178 | 5/1961 | Koch | 271/206 |
| 3,702,098 | 11/1972 | Eburn | 101/378 |
| 3,792,857 | 2/1974 | Bubley | 271/85 |
| 3,924,849 | 12/1975 | Murakami | 271/204 |
| 4,031,824 | 6/1977 | Bubley | 271/85 |
| 4,058,307 | 11/1977 | Bubley | 271/268 |
| 4,284,301 | 8/1981 | Geiger | 271/268 |
| 4,460,083 | 7/1984 | Oyama | 271/85 |

FOREIGN PATENT DOCUMENTS

| | | | |
|---|---|---|---|
| 2337210 | 6/1975 | Fed. Rep. of Germany | 271/204 |

*Primary Examiner*—Clyde I. Coughenour
*Assistant Examiner*—William L. Klima
*Attorney, Agent, or Firm*—Collard, Roe & Galgano

[57] ABSTRACT

A gripper device for transporting and registering sheets of any type under the printing heads of silk screening and the like printing machines, which comprises a box-like supporting body having hingedly connected thereto, against the bias of preloaded spring members, a plate-like element forming a flat jaw, and juxtaposed thereto, a plurality of flat surface gripper elements which are set in mutual alignment and for oscillation about a parallel axis to said juxtaposed jaw and adapted to be brought close against said juxtaposed jaw by means of at least one slide element which is driven reciprocatingly by a drive shaft from the silk screen printer, said slide element being provided with an actuating means cooperating with means associated with said flat jaw and with said plurality of juxtaposed gripper elements and adapted to produce, as said slide is being reciprocated, a rotation of said plurality of gripper elements about their own axes toward said opposed flat jaw and to allow said flat jaw to be disengaged from said slide.

6 Claims, 3 Drawing Figures

8
8
8a
9
10
2
7
12
19a
19
3
12
11
18
5
17
16
15
13

4a
11
9
10
12
2
6
4
7
19a
19
17
2a
8a
3
A
A1
16
5
13
15

GRIPPER DEVICE FOR TRANSPORTING AND REGISTERING PLATES OR SHEETS TO BE OVERPRINTED ON SILK SCREEN PRINTING MACHINES IN ONE OR MORE COLORS

BACKGROUND OF THE INVENTION

This invention relates to a gripper device having flat jaws and being particularly useful for transporting and registering plates, flexible sheets, and the like substrates on single or multicolor silk screen printers.

As a rule, the plates or sheets of cloth, paper, or the like, to be overprinted on silk screen printers are fed into the printing stations from a pack of such plates or sheets. To this aim, each individual sheet is picked up and transported flat by grippers which can be shifted in timed relationship with the printing operations.

To ensure that the individual sheets, or plates, can be picked up always on the same plane, i.e. the plane containing the sheet itself, it is common practice to use twin jaw grippers wherein one jaw is held stationary and the other spread open or otherwise lifted from the stationary one, thus permitting a gripper to be opened and closed, and the sheet or plate to be correspondingly released and gripped.

These prior grippers have some practical disadvantages, especially where the sheets or plates to be transported comprise a material lacking adequate rigidity of its own. In this case, in fact, it may happen that a margin edge of a sheet being picked up does not lay true, for reasons due to deformation of the sheet itself, against the support surface and fails to enter, or only enters irregularly, the nip between the gripper jaws.

SUMMARY OF THE INVENTION

Accordingly, it is an object of this invention to provide a gripper device for transporting and registering sheets or plates to be overprinted on a silk screen printer, which is constructed to avoid the above-mentioned disadvantages, that is, which can reliably grip sheets even when the latter are distorted and in less than perfect contact with their sliding surface, while ensuring at all times flatness of the closure line.

Another object of the invention is to provide a gripper having spread-apart gripping elements and being simple and inherently strong construction-wise, of reduced overall size, and suitable for use with any types of silk screen or the like printers.

These and other objects, such as will become apparent from the description which follows, are achieved by a gripper device for transporting and registering generic sheets under the printing heads of silk screen or the like printers, which device comprises, according to this invention, a box-like supporting body having hingedly connected thereto, against the bias of preloaded spring members, a plate-like element forming a flat jaw, and juxtaposed to said flat jaw, a plurality of flat surface mutually aligned gripping elements set for oscillation about a parallel axis to said opposed jaw and being adapted to be brought close against said opposed jaw by at least one slide element reciprocatingly driven by a drive shaft from the silk screen printer, said slide element being provided with an actuating means cooperating with a means, associated with said flat jaw and plurality of juxtaposed gripping elements, operative to produce, as said slide is being reciprocated, a rotation of said plurality of gripping elements about their own axes toward said flat jaw and to allow disengagement of said flat jaw from said slide, and accordingly the closure thereof, through said spring members, against said plurality of juxtaposed gripping elements.

More particularly, said moving slide comprises a prismatic body arranged for translation inside said box-like supporting body and being provided on the front with inclined surface means adapted to rotatively bias said plurality of flat gripping elements and, at the top thereof, with at least a flared groove associated with a ridge fastened to said flat jaw.

BRIEF DESCRIPTION OF THE DRAWINGS

The invention is described more detailedly hereinafter, with reference to the accompanying drawings, given by way of example and not of limitation, and where.

DESCRIPTION OF THE PREFERRED EMBODIMENTS

Figures 1, 2:
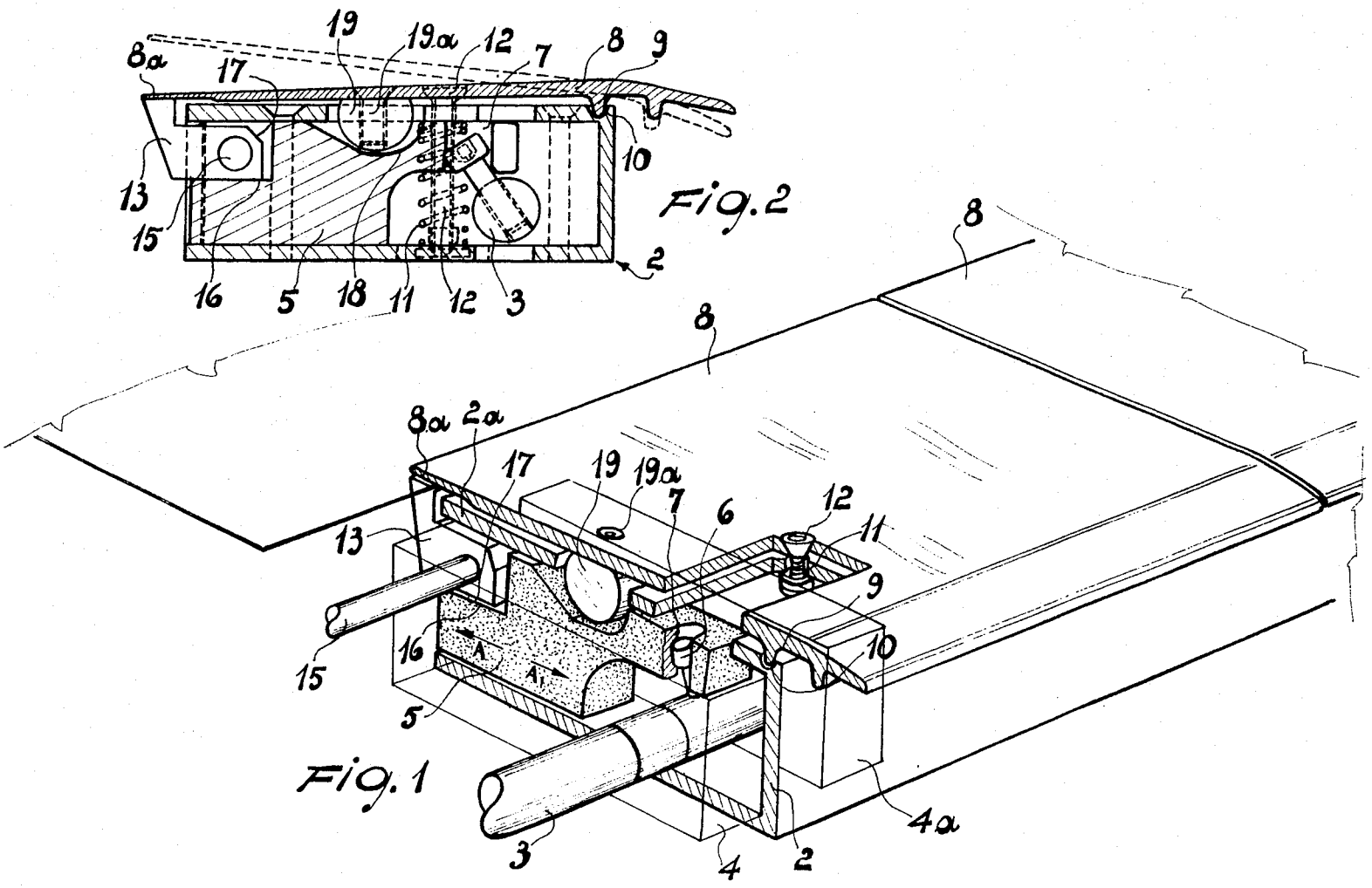
FIG. 1 is a perspective view of a gripper device with jaws in the closed (gripping) position, as provided by this invention.
FIG. 2 is a cross-sectional view taken along the line II—II of FIG. 1.

Making reference to the drawing views, the gripper device of this invention comprises one or more flat supports 1 on which is located a parallelepipedal box-like body 2 having substantially the same length as the longitudinal dimension of the gripper. Mounted rotatably within the box-like body 2 is a drive shaft 3 which is supported, at preset distances, on vertical lateral sides 4–4*a*, etc. and is rotated in alternate directions for operation, through a conventional means, in timed relationship to the printing operations. Also inside the body 2, a prismatic slide element 5 is provided which may be reciprocated perpendicularly to the drive shaft 3 as indicated by the arrows A–A1 in FIG. 1, as by means of a pawl or pin 6 which stands proud of the shaft 3 and is inserted into a groove 7 formed on the slide 5. The engagement of the pin 6 in the groove 7 enables the slide to move in either directions through a preset distance dependent on a given width of the rotation angle of the shaft 3 in either directions.

Located at the top of the body 9 coplanarly with the top face 2*a* of the body 2, is a flat plate-like element 8 forming the upper jaw of the gripper; this is mounted for oscillation on the body 2 by interlock relationship of a projecting rib 9 thereof which spans the full length of the plate 8 with an appropriate recess 10 formed along the side of the body 2 adjacent the drive shaft. The continuous jaw 8 is biased toward the surface 2*a* of the body 2 by a tension spring 11 and guided by a threaded pin 12 spanning the full height of the box-like body 2. The flat jaw 8 has a greater width dimensions than the surface 2*a* of the box-like body 2 so as to allow a portion 8*a* to protrude which will form the clamping area with the juxtaposed jaws.

The gripping elements (or juxtaposed jaws) adapted for closing against (and opening away from) the upper jaw 8 comprise blocks 13–13*a*, etc. of substantially L-like configuration which have their vertical leg terminated with a flat surface 14 that forms the gripping area against the strip 8*a* of the upper jaw 8. Each block 13–13*a* is mounted pivotally around a fixed shaft 15 which extends parallel to the drive shaft 6 and hence perpendicular to the travel direction of the slide 5. Thus, all of the blocks which form the gripping elements are mounted oscillatingly, i.e. may be tilted around a common shaft 15 and have a limited gripping area 14; furthermore, for each upper jaw 8, there are provided two blocks 13 because this arrangement affords a constantly planar and secure grip on sheets which may be less than perfectly flat.

Figure 3:
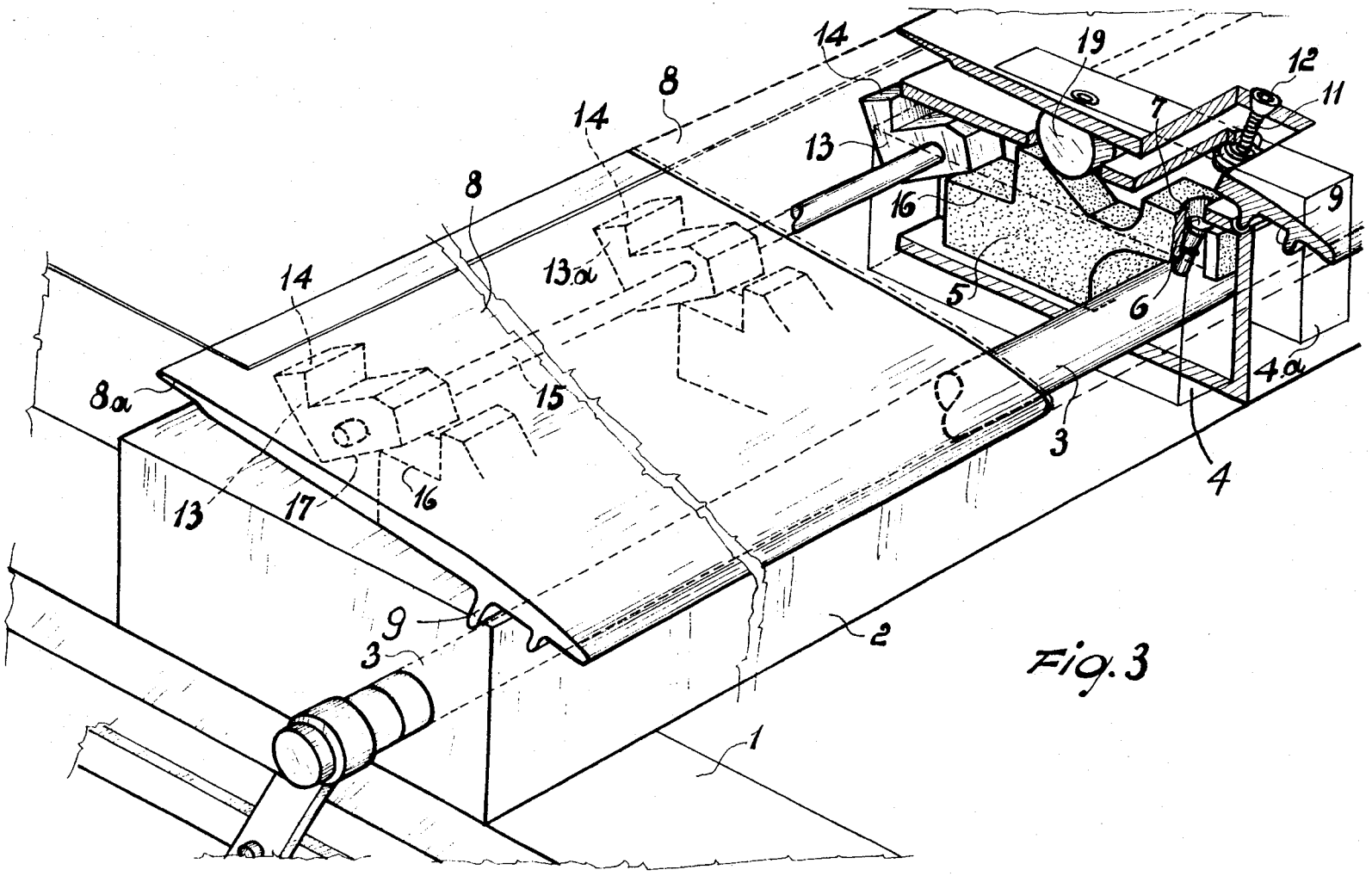
FIG. 3 shows, partly in perspective and partly in section, devices embodied as in the preceding Figures and being aligned to one another to form a unitary gripper with plural gripping elements of a suitable size to fit the plate or sheet to be gripped and transported.

The gripping blocks 13 are moved closer to the opposed jaw 8 by the slide 5 itself, which is provided to that aim, at the remote end from that associated with the drive shaft, with a deep step or bevel the bottom side 16 whereof, by moving in contact with the base 17 of the block 13, causes the block 13 to turn from its tilted position (FIG. 3) to its gripping position (FIGS. 1 and 2). The various blocks are returned to the open condition automatically and freely by their own weight.

Displacement of the upper portion 8, and precisely lifting of the portion 8, is also caused by the movement of the slide 5; to that aim, the slide has at the top of a circular flared groove 18, and at the latter location, the bottom surface of the jaw 8 has a cylindrical pin 19 associated therewith which has a horizontal axis and is fastened by means of a screw 19*a*. The pin 19 is sized to be received inside the groove 18 of the slide as this is moved in the direction of the arrow A (FIG. 1); movement of the slide in the direction of the arrow A1 causes instead the pin 19 to move out of the groove and hence the upper jaw 8 to be opened. The grip between the portion 8 and lower blocks is maintained automatically by the tension spring 11 with the pin 19 received into the groove 18.

In practice, each gripper device comprises two or more mutually aligned coplanar jaws 8 (FIG. 3), at least one pair of tiltable blocks 13 being arranged to correspond to each of them; both the tiltable blocks and various opposed jaws are driven by a single drive shaft 3 and by plural slides, while the blocks are mounted for oscillation on a single fixed shaft 15. This embodiment affords true planarity of the gripping line and the possibility of also picking up flexible sheets which are not truly planar, because both the upper and lower jaws may be mutually spread apart.

Thus, the operation of the gripper device just described may be clearly summarized as follows. The rotation in alternate directions of the drive shaft, through conventional arrangements and in synchronization with the various operating steps of the silk screen printer, causes both of the juxtaposed jaws to open and close. In fact, a displacement of the slide 5 in the direction of the arrow A1, as caused by the pawl 6 engaging with the slide, at each rotation of the drive shaft forces the pin 19 out of the groove 18; the pin moves up and lifts the jaw 8 causing it to rotate around its hinge connection area 9–10. The slide 5 also causes, in the course of that same displacement movement, a partial disengagement of its step 16 from the bases of the blocks 13, thereby the latter, under their own weight, rotate around the shaft 15 and move the gripping surfaces 14 away from the gripping line.

A translatory movement of the slide in the direction of the arrow A (FIG. 1) causes instead the pin 19 to be inserted into the groove 18, thereby the tension spring 11 will bring the upper jaw down to close and the blocks 13–13*a* to rotate and bring the surfaces 14 thereof into gripping relationship with the strip 8*a* of the upper jaws. The slides 5 are made of a low frictional coefficient material with respect to that of the box-like body 2 wherein they are reciprocated.

Of course, the invention as described in the foregoing may be variously modified both structurally and functionally to meet individual application requirements, without departing from the scope thereof.

I claim:

1. A gripper device for transporting and registering sheets and plates in single or multicolor silk screen printers, comprising a box-like supporting body having hingedly connected thereto a plate-like element forming a flat jaw, a preloaded spring member biased against said plate-like element, a plurality of flat surface mutually aligned gripping elements set for oscillation about an axis parallel to the axis of rotation of said plate-like element and actuated to close against said flat jaw by at least one slide element, reciprocatingly driven by a drive shaft from the silk screen printer, contacting said gripping elements, said slide element being provided with an actuating means cooperating with a means associated with said flat jaw and plurality of juxtaposed gripping elements operative to produce, as said slide is being reciprocated, a rotation of said plurality of gripping elements about their own axes toward said flat jaw and to allow disengagement of said flat jaw from said slide, and accordingly the closure thereof, through said spring members, against said plurality of juxtaposed gripping elements.

2. A gripper device according to claim 1, characterized in that said slide comprises a prismatic body formed from a low frictional coefficient material and being mounted for translation within said box-like supporting body and driven by said drive shaft in alternate directions through a pin projecting from said shaft and being freely accommodated in a groove formed on the slide itself.

3. A gripper device according to claim 1, characterized in that said means for actuating the upper jaw and juxtaposed gripping elements comprises, for the upper jaw, an ovalized groove formed on said slide and a pin associated with said jaw, said pin being such as to fully insert itself into and move out of said groove on said slide being displaced, while for actuating the juxtaposed gripping elements mutually cooperating abutment surfaces are provided both on said slide and said juxtaposed gripping elements, thereby said gripping elements are rotated to close upon the slide being displaced.

4. A gripper device according to claim 1, characterized in that said oscillating gripping elements are mounted idly on a fixed shaft and comprise substantially L-like prismatic blocks having at one end a flat gripping surface, said blocks being mounted on said fixed shaft so as to swing open under their own weight.

5. A gripper device according to claim 3, characterized in that said upper jaw is hingedly connected to one side of said supporting box-like body by insertion of a continuous rib or ridge thereof into a groove formed on the box-like body itself, said jaw being biased closed by at least one tension spring.

6. A gripper device according to claim 3, characterized in that it comprises plural upper jaws aligned on a common plane, and at each of said upper jaws, at least one pair of oscillating gripping elements driven by a respective one of said slides.

* * * * *